US011262687B2

(12) United States Patent
Okamoto

(10) Patent No.: US 11,262,687 B2
(45) Date of Patent: Mar. 1, 2022

(54) WASTE TONER STORAGE CASE, IMAGE FORMING APPARATUS

(71) Applicant: KYOCERA Document Solutions Inc., Osaka (JP)

(72) Inventor: Kazuhiro Okamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/307,326

(22) Filed: May 4, 2021

(65) Prior Publication Data

US 2021/0349418 A1 Nov. 11, 2021

(30) Foreign Application Priority Data

May 11, 2020 (JP) ..... JP2020-083158

(51) Int. Cl.
*G03G 21/12* (2006.01)
*G03G 21/10* (2006.01)

(52) U.S. Cl.
CPC ..... *G03G 21/12* (2013.01); *G03G 21/105* (2013.01)

(58) Field of Classification Search
CPC ..... G03G 21/12; G03G 21/105
See application file for complete search history.

(56) References Cited

U.S. PATENT DOCUMENTS 6,085,062 A * 7/2000 Mizuishi ..... G03G 21/105 399/358
6,266,511 B1 * 7/2001 Murakami ..... G03G 21/105 222/DIG. 1
8,989,647 B2 * 3/2015 Toshiyuki ..... G03G 21/10 399/360
2016/0124377 A1 5/2016 Mizutani

FOREIGN PATENT DOCUMENTS

JP 2016090617 A 5/2016

* cited by examiner

*Primary Examiner* — Walter L Lindsay, Jr.
*Assistant Examiner* — Milton Gonzalez
(74) *Attorney, Agent, or Firm* — Alleman Hall Creasman & Tuttle LLP

(57) ABSTRACT

A waste toner storage case includes a case main body, a waste toner path, a conveyance portion, a conversion portion, and a moving member. The waste toner path is provided in the case main body. The conversion portion converts a rotary motion into a reciprocating motion in conjunction with a rotation of the rotation shaft. The moving member is coupled with the conversion portion, reciprocatingly moves in a direction along the inclined guide surface in accordance with the reciprocating motion from the conversion portion, and includes: a first extending portion extending from the coupling portion to the reception port; and a second extending portion extending from the coupling portion to the reception port to make a predetermined angle with respect to the first extending portion in a first direction separating from the inclined guide surface.

6 Claims, 11 Drawing Sheets

WASTE TONER STORAGE CASE, IMAGE FORMING APPARATUS

INCORPORATION BY REFERENCE

This application is based upon and claims the benefit of priority from the corresponding Japanese Patent Application No. 2020-083158 filed on May 11, 2020, the entire contents of which are incorporated herein by reference.

BACKGROUND

The present disclosure relates to a waste toner storage case for storing waste toner discharged from an image carrier, and relates to an image forming apparatus that includes the waste toner storage case.

There is known an image forming apparatus that forms an image using developer such as toner, and includes a cleaning device configured to remove toner (waste toner) that has remained on an image carrier after an image transfer. The waste toner removed by the cleaning device is conveyed to a waste toner storage case by passing a guide path provided in the waste toner storage case and is reserved in a storage space inside the waste toner storage case.

In this type of image forming apparatus, the waste toner may stagnate in the guide path of the waste toner storage case. To eliminate the stagnation, a moving member is provided to scrape loose the waste toner that has stagnated in the guide path, and the moving member is operated to scrape the stagnating waste toner down to the inner storage space.

SUMMARY

A waste toner storage case according to an aspect of the present disclosure includes a case main body, a waste toner path, a conveyance portion, a conversion portion, and a moving member. The case main body is configured to store waste toner discharged from an image carrier included in an image forming apparatus. The waste toner path is provided in the case main body and includes an inclined guide surface that guides the waste toner diagonally downward from a reception port that receives the waste toner from the image carrier, toward an inside of the case main body. The conveyance portion is provided in the inside of the case main body in such a way as to be rotatable and configured to, by being rotated, convey the waste toner in the case main body in a rotation axis line direction. The conversion portion is provided in a rotation shaft of the conveyance portion and configured to convert a rotary motion into a reciprocating motion in conjunction with a rotation of the rotation shaft. The moving member is coupled with the conversion portion and extends in the waste toner path from a coupling portion that couples the moving member with the conversion portion, toward the reception port. The moving member is configured to reciprocatingly move in a direction along the inclined guide surface in accordance with the reciprocating motion transmitted from the conversion portion. The moving member includes: a first extending portion extending from the coupling portion to the reception port; and a second extending portion extending from the coupling portion to the reception port to make a predetermined angle with respect to the first extending portion in a first direction that is a direction separating from the inclined guide surface.

An image forming apparatus according to another aspect of the present disclosure includes the waste toner storage case, the image carrier, and a waste toner removing portion. The image carrier is configured to carry a toner image. The waste toner removing portion is configured to remove the waste toner from a surface of the image carrier and discharge the waste toner to the waste toner storage case.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

Figure 1:
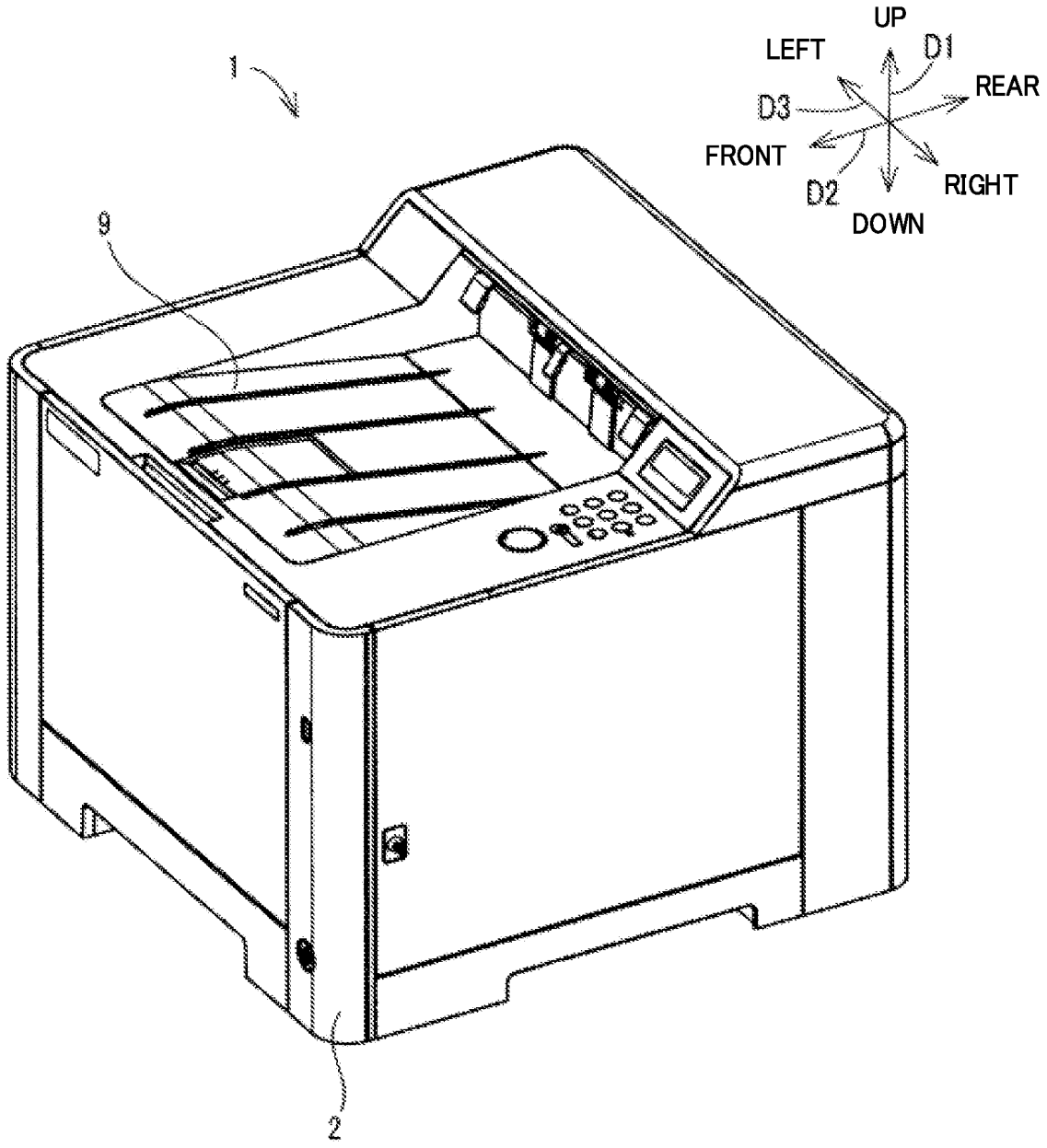
FIG. 1 is a diagram showing a configuration of an image forming apparatus according to an embodiment of the present disclosure.

FIG. 1 is an external perspective diagram showing a configuration of an image forming apparatus 1 according to the embodiment of the present disclosure. In the following, an up-down direction D1, a front-rear direction D2, and a left-right direction D3 (or a width direction D3) are used to describe the present embodiment, wherein the directions are defined on the basis of a state (the state shown in FIG. 1) where the image forming apparatus 1 is in normal use.

The image forming apparatus 1 shown in FIG. 1 is a printer. The image forming apparatus 1 prints an image of an input image on a print sheet by using a print material such as toner. It is noted that the image forming apparatus 1 is not limited to a printer, but may be a facsimile, a copier, or a multifunction peripheral having functions of these.

The image forming apparatus 1 prints an image on a print sheet based on image data that has been input from outside via a network communication portion (not shown). As shown in FIG. 1, the image forming apparatus 1 includes a housing 2 that includes an exterior panel, a cover, and an internal frame.

Figure 2:
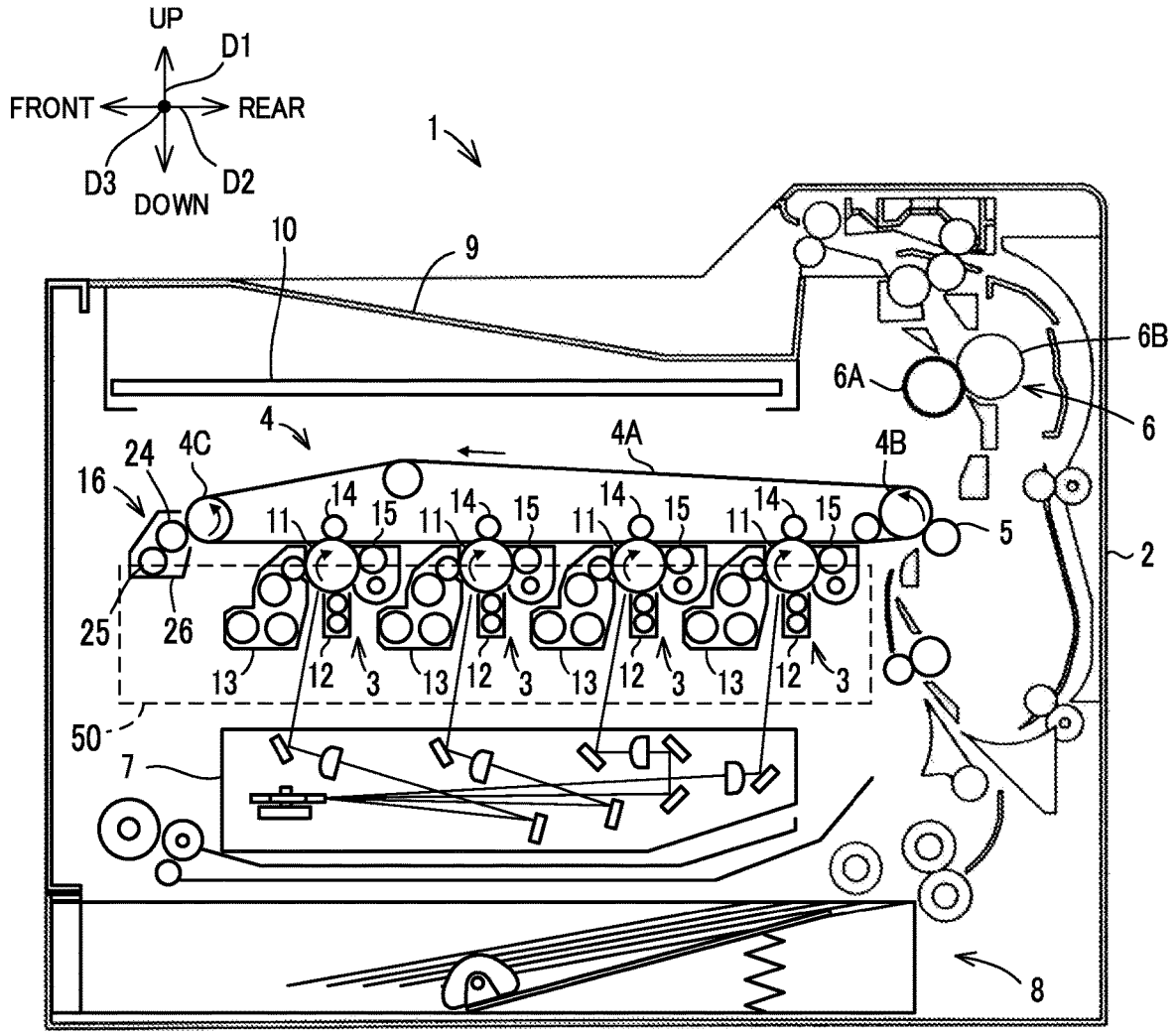
FIG. 2 is a diagram showing an internal configuration of the image forming apparatus of FIG. 1.

FIG. 2 is a diagram showing an internal configuration of the image forming apparatus 1. The image forming apparatus 1 is what is called a tandem color printer and as shown in FIG. 2, includes a plurality of image forming portions 3, an intermediate transfer unit 4, a secondary transfer device 5, a fixing device 6, an exposure device 7, a sheet feed device 8, a sheet discharge portion 9, a control portion 10, a belt cleaning device 16 (an example of a waste toner removing portion of the present disclosure), and a waste toner storage case 50 (an example of a waste toner storage case of the present disclosure).

The plurality of image forming portions 3 are arranged in alignment in the front-rear direction D2. The plurality of image forming portions 3 respectively form toner images of different colors. In FIG. 2, an image forming portion 3 that is disposed on the most rear side forms a toner image with black toner. An image forming portion 3 that is the second from the rear forms a toner image with yellow toner. An image forming portion 3 that is the third from the rear forms a toner image with cyan toner. An image forming portion 3 that is disposed on the most front side forms a toner image with magenta toner. Each of the image forming portions 3 includes a photoconductor drum 11, a charging device 12, a developing device 13, a primary transfer device 14, and a drum cleaning device 15. As a result, the image forming apparatus 1 includes a plurality of photoconductor drums 11, a plurality of developing devices 13, and a plurality of drum cleaning devices 15.

The intermediate transfer unit 4 includes an intermediate transfer belt 4A (an example of an image carrier of the present disclosure), a driving roller 4B, and a driven roller 4C. The intermediate transfer belt 4A carries a toner image that is formed from toner images of a plurality of (in the present embodiment, four) colors. Supported by the driving roller 4B and the driven roller 4C so as to be rotationally driven, the intermediate transfer belt 4A can move (run) in the state where its surface is in contact with the surfaces of the photoconductor drums 11. When the intermediate transfer belt 4A is rotationally driven, its surface passes through between the photoconductor drums 11 and the primary transfer devices 14. At that time, the toner images of respective colors are transferred in sequence from the photoconductor drums 11 to the surface of the intermediate transfer belt 4A in such a way as to be overlaid with each other.

The secondary transfer device 5 transfers the toner image transferred on the intermediate transfer belt 4A, to a print sheet that is conveyed from the sheet feed device 8. The print sheet with the toner image transferred thereon is conveyed to the fixing device 6. The fixing device 6 includes a heating roller 6A and a pressure roller 6B. The fixing device 6 conveys the print sheet with the toner image transferred thereon while applying heat and pressure thereto. This allows the toner image to be fused and fixed to the print sheet. The print sheet with the toner image fixed thereto is further conveyed toward the downstream side, and discharged onto and held by the tray-like sheet discharge portion 9 disposed above the intermediate transfer unit 4.

The belt cleaning device 16 is disposed in front of the intermediate transfer unit 4. The belt cleaning device 16 includes a cleaning roller 24, a screw member 25, and a toner box 26, wherein the cleaning roller 24 is a cleaning member. The cleaning roller 24 is disposed to face the driven roller 4C, and its surface is in contact with the intermediate transfer belt 4A. The length of the cleaning roller 24 is approximately the same as the width of the intermediate transfer belt 4A.

The cleaning roller 24 is rotatably supported in the toner box 26. The cleaning roller 24 rotates when a rotational driving force is input to the rotation shaft of the cleaning roller 24. The cleaning roller 24 is rotated while in contact with the intermediate transfer belt 4A, thereby removing toner that has remained on the surface of the intermediate transfer belt 4 after the transfer of the toner image by the secondary transfer device 5. The removed toner (hereinafter referred to as "waste toner") is taken into the toner box 26 by the action of gravity or by the rotation of the cleaning roller 24. The waste toner taken into the toner box 26 is conveyed by the screw member 25 as a toner conveyance member toward the waste toner storage case 50.

A cylindrical discharge portion 28 (see FIG. 4) is provided in a lower part of a right end portion of the toner box 26. The discharge portion 28 includes a discharge port 27 (see FIG. 4) that is opened downward. The discharge portion 28 is coupled with a case main body 52 (see FIG. 4, FIG. 5) of the waste toner storage case 50 that is described below. The screw member 25 has a helical blade around a columnar shaft member. When the screw member 25 is rotated, the waste toner receives the action of the blade and is conveyed in the toner box 26 toward the discharge portion 28. The waste toner is then discharged from the discharge port 27 to the case main body 52. That is, the toner that has remained on the surface of the intermediate transfer belt 4A is removed by the belt cleaning device 16 and is discharged, as the waste toner, from the intermediate transfer belt 4A to the case main body 52.

Figure 3:
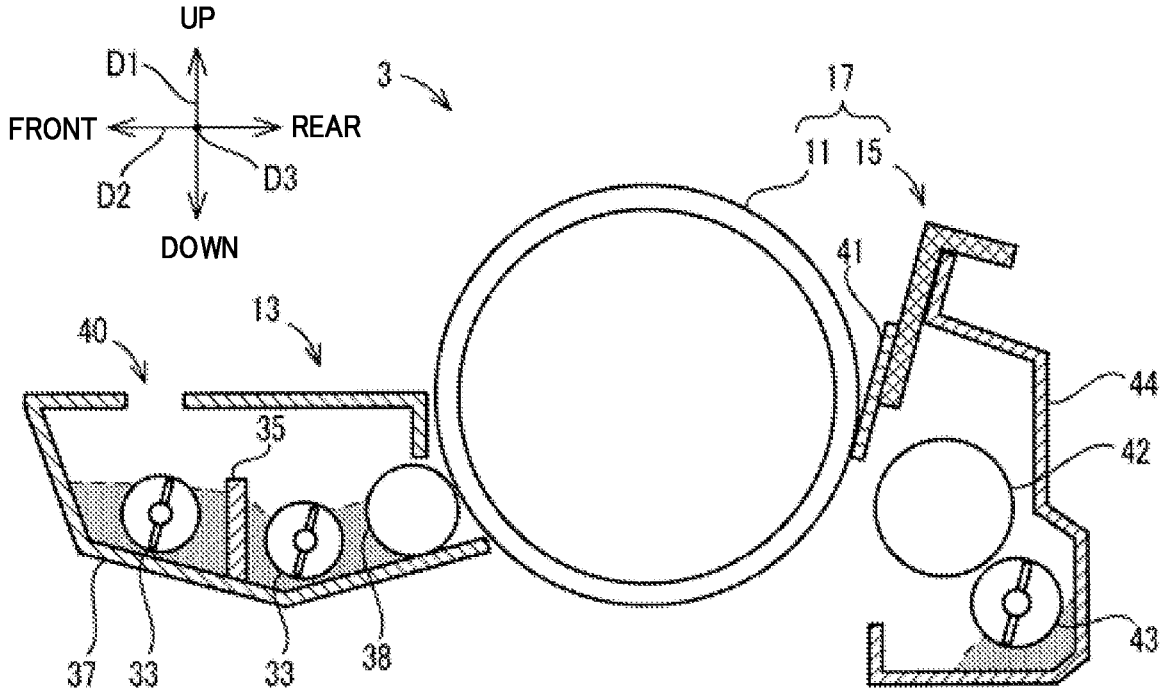
FIG. 3 is a diagram showing a configuration of an image forming portion included in the image forming apparatus of FIG. 1.

FIG. 3 is a cross-section diagram schematically showing the photoconductor drum 11, the developing device 13, and the drum cleaning device 15 provided in the image forming portion 3. In FIG. 3, the charging device 12 and the primary transfer device 14 are omitted. The plurality of image forming portions 3 have the same configuration except that they use different colors of toner.

The photoconductor drum 11 is a tubular rotator with a photosensitive layer formed on its surface. The photoconductor drum 11 is rotatably supported in the housing 2, and rotates in a predetermined direction upon input of a rotational driving force. A toner image of a corresponding color is held on the surface of the photoconductor drum 11. Specifically, when the exposure device 7 exposes the surface of the photoconductor drum 11 to light in a state where the surface of the photoconductor drum 11 has been charged to a predetermined potential by the charging device 12, an electrostatic latent image is formed on the surface of the photoconductor drum 11. The electrostatic latent image is developed by the developing device 13 that is described below. This allows a toner image to be carried on the surface of the photoconductor drum 11. The toner image on the photoconductor drum 11 is transferred onto the intermediate transfer belt 4A by the primary transfer device 14.

The developing device 13 visualizes, by the developer, the electrostatic latent image formed on the surface of the photoconductor drum 11. The developing device 13 includes a developer case 37 and a magnet roller 38. The developer case 37 stores the developer that includes the toner. The magnet roller 38 is used in the developing and rotatably supported in the developer case 37. A bias of a polarity that is the same as a charge polarity of the photoconductor drum 11 is applied to the magnet roller 38. A stirring screw (not shown) is provided in the developer case 37. With the rotation of the stirring screw, the developer is stirred and the toner is charged to a predetermined potential. In addition, the charged toner is conveyed by the magnet roller 38 to a position that faces the photoconductor drum 11, and at the position, the toner is caused to fly toward the electrostatic latent image on the surface of the photoconductor drum 11. This allows the electrostatic latent image on the surface of the photoconductor drum 11 to be developed. The developer case 37 has a toner replenishing port 40, and the toner is replenished from a toner container (not shown) to the developer case 37 via the toner replenishing port 40.

Figure 4:
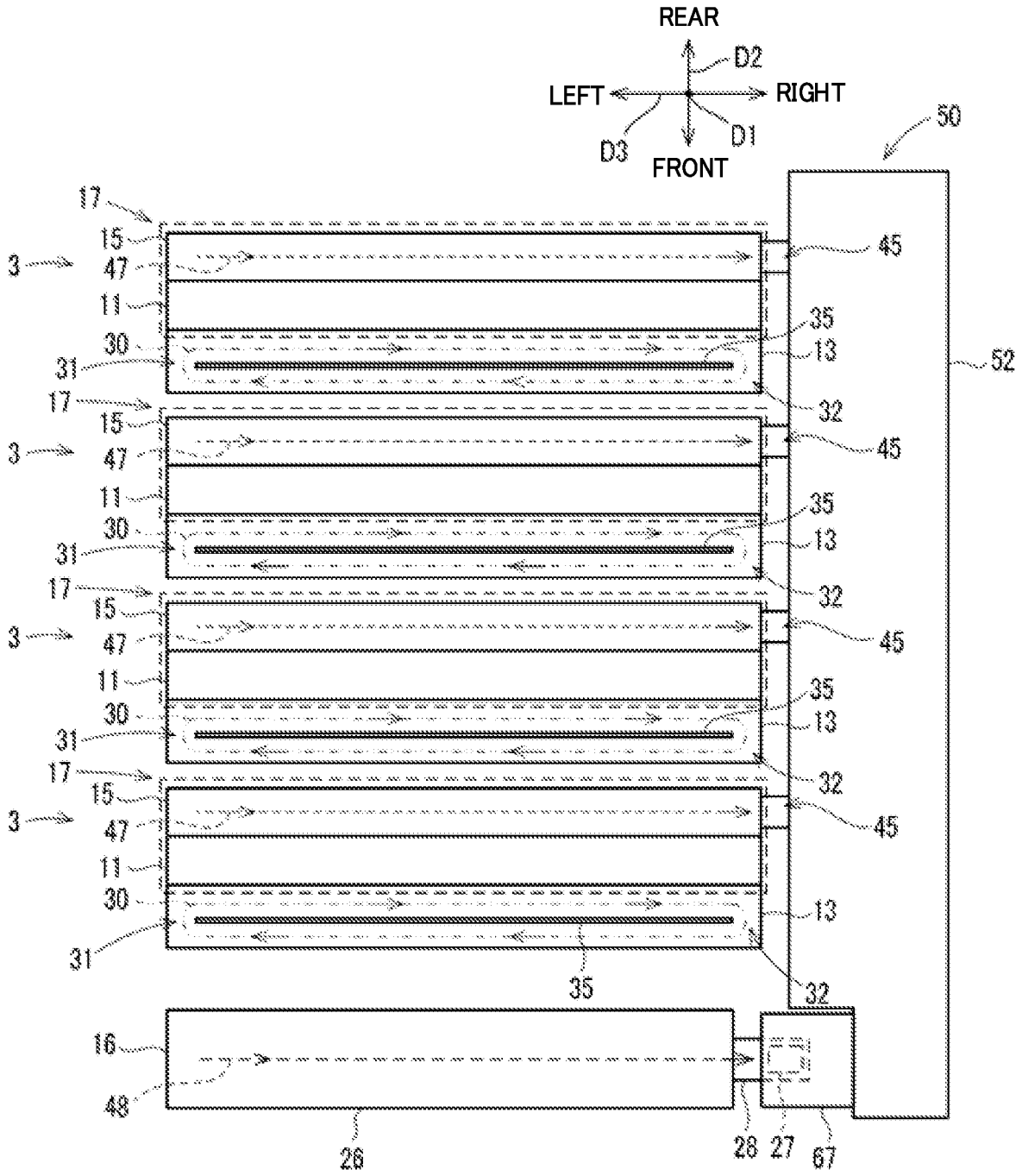
FIG. 4 is a diagram for explaining a toner flow path in which waste toner that has been removed from photoconductor drums and an intermediate transfer belt by cleaning devices flows before flowing into a waste toner storage case.

FIG. 4 is a plan diagram schematically showing the plurality of image forming portions 3, the belt cleaning device 16, and the waste toner storage case 50. FIG. 4 shows a toner discharge flow path along which the waste toner removed from the photoconductor drum 11 and the intermediate transfer belt 4A by the drum cleaning device 15 and the belt cleaning device 16 flows into the waste toner storage case 50.

As shown in FIG. 4, the developer case 37 of the developing device 13 includes a partition wall 35. The partition wall 35 is erected on a bottom of the developer case 37 to extend along the longitudinal direction of the developer case 37 (a direction that matches the left-right direction D3). The inner space of the developer case 37 is partitioned into two spaces by the partition wall 35. The two spaces communicate with each other via communication portions 31 and 32 that are provided at opposite ends in the longitudinal direction. In addition, the two spaces are each provided with a stirring screw member 33 (see FIG. 3) that conveys the developer while stirring it. With the rotation of the stirring screw members 33, the developer in the developer case 37 is conveyed and circulated in the two spaces along a circulation path 30 (see the two-dotted line in FIG. 4).

As shown in FIG. 3, the drum cleaning device 15 is disposed in the rear side of the photoconductor drum 11. The drum cleaning device 15 is disposed for each of the photoconductor drums 11. The drum cleaning device 15 includes a cleaning blade 41 that is a cleaning member, a cleaning roller 42, a screw member 43, and a toner box 44. The cleaning blade 41 and the cleaning roller 42 have approximately the same length as the photoconductor drum 11. The cleaning blade 41 is disposed such that its edge is in contact with or close to the surface of the photoconductor drum 11.

The cleaning roller 42 is rotatably supported in the toner box 44. The cleaning roller 42 rotates when a rotational driving force is input to the rotation shaft of the cleaning roller 42. When the photoconductor drum 11 is rotated, the cleaning blade 41 removes toner that has remained on the surface of the photoconductor drum 11 after the image transfer by the primary transfer device 14. The removed toner (hereinafter referred to as "waste toner") is taken into the toner box 44 by the action of gravity or by the rotation of the cleaning roller 42. The waste toner taken into the toner box 44 is conveyed by the screw member 43 in a discharge direction as indicated by an arrow 47 in FIG. 4.

A discharge port 45 (see FIG. 4) is formed in the right-end side wall of the toner box 44. The discharge port 45 is coupled with the case main body 52 (see FIG. 4, FIG. 5) of the waste toner storage case 50. The screw member 43 has a helical blade around a columnar shaft member. When the screw member 43 is rotated, the waste toner receives the action of the blade and is conveyed in the toner box 44 toward the discharge port 45. The waste toner is then discharged from the discharge port 45 to the case main body 52. That is, the toner that has remained on the surface of the photoconductor drum 11 is removed by the drum cleaning device 15 and is discharged, as the waste toner, from the photoconductor drum 11 to the case main body 52.

Each pair of the photoconductor drum 11 and the drum cleaning device 15 is unitized as a drum unit 17 (see FIG. 4). The discharge ports 45 included in the drum cleaning devices 15 project respectively from housings (not shown) of the drum units 17 to outside and are coupled with reception ports 65 (65A-65D) of the waste toner storage case 50 that is described below.

As shown in FIG. 4, the waste toner removed by the drum cleaning devices 15 is conveyed by the screw members 43 in the discharge direction (see the arrows 47) which is oriented rightward in the left-right direction D3 of the image forming apparatus 1. The waste toner that has been conveyed and arrived at the right ends of the toner boxes 44 passes through the discharge ports 45 and the reception ports 65 (65A-65D) of the waste toner storage case 50, and is discharged into the case main body 52 that is described below.

In addition, the waste toner removed from the intermediate transfer belt 4A by the belt cleaning device 16 is conveyed by the screw member 25 in the discharge direction (see an arrow 48) which is oriented rightward in the left-right direction D3 of the image forming apparatus 1. The waste toner that has been conveyed and arrived at the right end of the toner box 26 passes through the discharge portion 28 that is provided in the toner box 26, passes through a reception port 65 (65E) of the waste toner storage case 50, and is discharged into the case main body 52 that is described below.

As shown in FIG. 2, the waste toner storage case 50 is provided in the housing 2. More specifically, the waste toner storage case 50 is disposed below the intermediate transfer belt 4A. In addition, as shown in FIG. 4, the waste toner storage case 50 is disposed more on the right side than the right ends of the drum cleaning devices 15 and the belt cleaning device 16.

Figure 5:
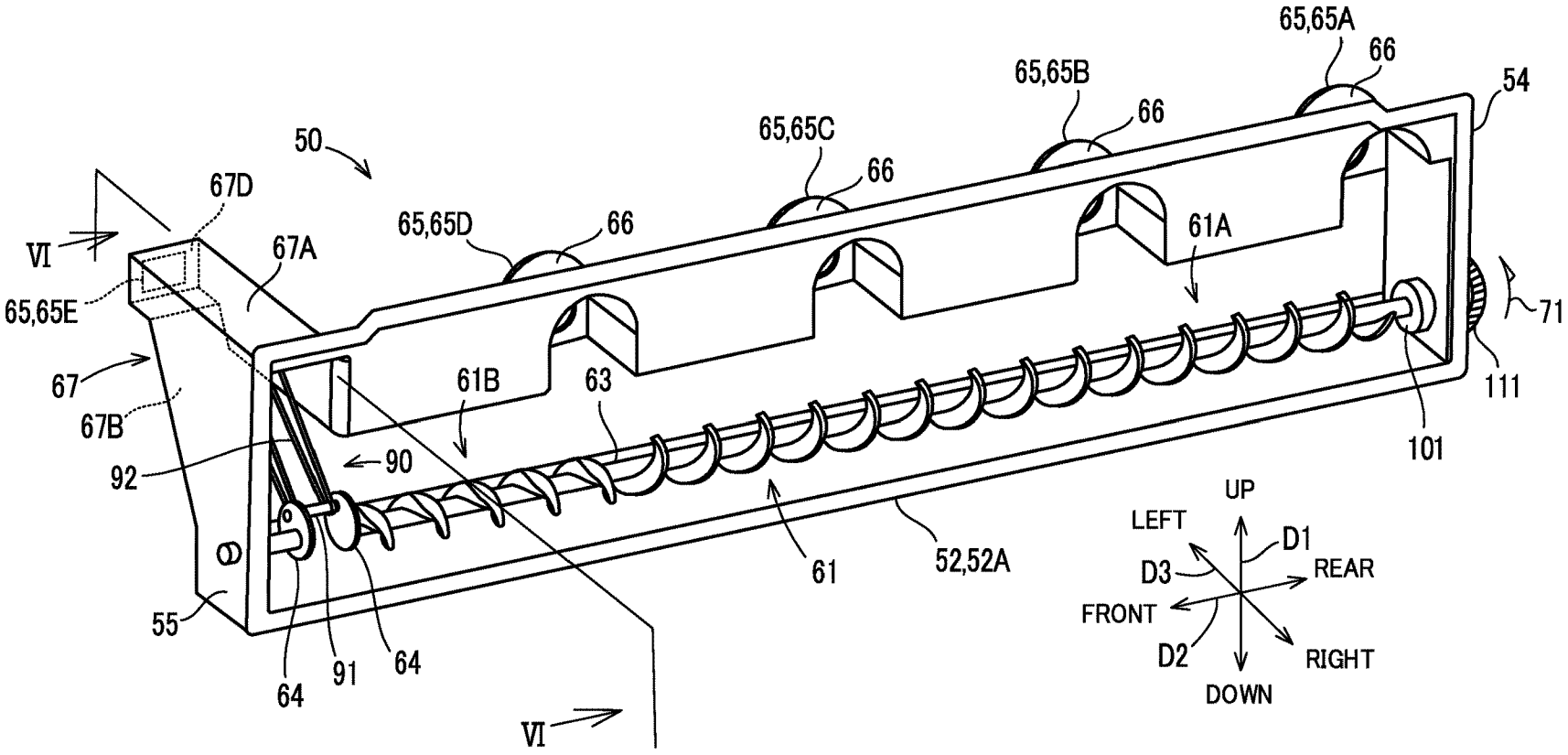
FIG. 5 is a diagram showing a configuration of the waste toner storage case according to an embodiment of the present disclosure.

As shown in FIG. 5, the waste toner storage case 50 includes the case main body 52 (an example of a case main body of the present disclosure), a conveyance screw 61 (an example of a conveyance portion of the present disclosure), and a loosening mechanism 90. Here, FIG. 5 is a perspective diagram viewing the waste toner storage case 50 from the right side. It is noted that in FIG. 5, a cover portion constituting a part of the case main body 52 is omitted for the sake of convenience of explanation.

Figure 6:
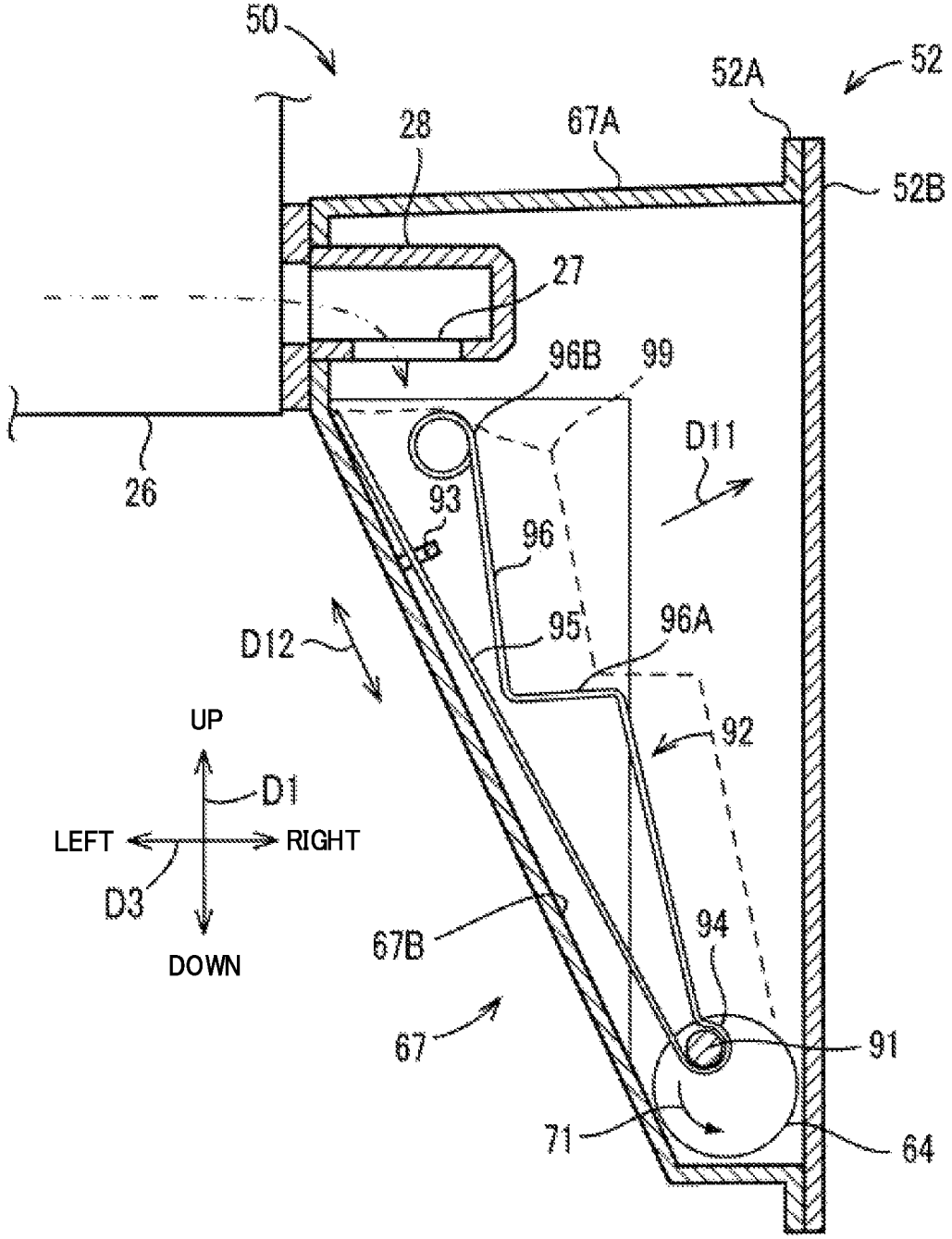
FIG. 6 is a cross-section diagram of a loosening member provided in a waste toner storage case taken along a cut plane VI-VI of FIG. 5.

The case main body 52 includes a main body case 52A and a cover portion 52B (see FIG. 6). The case main body 52 is formed to be elongated in the front-rear direction D2. The main body case 52A constitutes a left part of the case main body 52 (the image forming portions 3 side), and the cover portion 52B constitutes a right part of the case main body 52. The cover portion 52B is attached to the right side of the main body case 52A to form the case main body 52 having a storage space inside.

The waste toner discharged from the drum cleaning devices 15 and the belt cleaning device 16 is stored in the case main body 52. Specifically, five reception ports 65 (65A-65E) are provided in the left side of the main body case 52A, and the waste toner flows in from the reception ports 65.

Four reception ports 65 (65A-65D) having the same shape are provided in the left side of the main body case 52A. The reception ports 65A-65D are provided at equal intervals in the front-rear direction D2, and disposed at approximately the same height position. The reception ports 65A-65D are provided at positions respectively corresponding to the four image forming portions 3, and are coupled with the discharge ports 45 of the drum cleaning devices 15 provided in the image forming portions 3. That is, the waste toner that has been removed from the photoconductor drums 11 and discharged by the drum cleaning devices 15 of the image forming portions 3 flows into the case main body 52 from the reception ports 65A-65D. The reception ports 65A-65D are respectively formed at the tips of tubular portions 66 that project leftward from the left side of the main body case 52A. The tubular portions 66 play a role of conveyance paths that guide the waste toner having entered the reception ports 65A-65D to the inside of the case main body 52.

The case main body 52 is provided with a toner path portion 67 (an example of a waste toner path of the present disclosure). The toner path portion 67 is provided in the most front side of the left side of the main body case 52A. In other words, the toner path portion 67 is provided in the main body case 52A at one side in a rotation axis line direction of the conveyance screw 61. The toner path portion 67 receives the waste toner that has been removed from the intermediate transfer belt 4A and discharged by the belt cleaning device 16, and guides the waste toner toward the inside of the case main body 52. The toner path portion 67 is formed to project leftward from the left side of the main body case 52A and includes a top wall 67A whose upper surface is a horizontal flat surface.

The reception port 65E is provided in the most front side of the left side of the main body case 52A. Specifically, the reception port 65E is formed in a left side wall 67D of the toner path portion 67, the left side wall 67D provided in an upper part of the toner path portion 67. The reception port 65E is an opening formed in the left side wall 67D, and is communicated with the inside of the toner path portion 67. The bottom surface of the guide portion 67 is an inclined surface 67B (an example of an inclined guide surface of the present disclosure) that is inclined diagonally downward from the reception port 65E toward the inside of the case main body 52. The reception port 65E is formed at a position that corresponds to the belt cleaning device 16. Specifically, the reception port 65E is formed at a position where it can be coupled with the discharge port 27 of the toner box 26. In the present embodiment, the discharge portion 28 of the toner box 26 is inserted in the reception port 65E such that the discharge port 27 is disposed inside the toner path portion 67. This allows the waste toner discharged from the discharge port 27 to flow into the reception port 65E. As a result, the waste toner that has been removed from the intermediate transfer belt 4A and discharged by the belt cleaning device 16 flows into the reception port 65E, passes through the inside of the guide portion 67, and slides down on the inclined surface 67B. That is, the waste toner is guided by the inclined surface 67B to move down and flow into the storage space of the case main body 52.

The case main body 52 is provided with the conveyance screw 61 to eliminate the unevenness of the bulk of the waste toner that is caused by the deviation of the amount of the waste toner flowing in. The conveyance screw 61 is rotatably provided inside the case main body 52.

The conveyance screw 61 is rotatably provided in the case main body 52 approximately at an intermediate position thereof in the up-down direction D1. The conveyance screw 61 is rotatably supported by a bearing 101 in the state of passing through side walls 54 and 55 provided at opposite ends in the longitudinal direction and being suspended between the side walls 54 and 55. When a rotational driving force of a driving motor (not shown) is input to an input gear 111 provided in the side wall 54, the conveyance screw 61 is rotated in a direction indicated by an arrow 71. By being rotated, the conveyance screw 61 conveys the waste toner in the case main body 52 in the rotation axis line direction.

The conveyance screw 61 includes a rear-side conveyance portion 61A and a front-side conveyance portion 61B. In the conveyance screw 61, the rear-side conveyance portion 61A and the front-side conveyance portion 61B are disposed on the same axis. The rear-side conveyance portion 61A, by being rotated, conveys the waste toner frontward along the rotation axis line direction. In addition, the front-side conveyance portion 61B, by being rotated, conveys the waste toner rearward along the rotation axis line direction. That is, when the conveyance screw 61 is rotated in the direction indicated by the arrow 71, the rear-side conveyance portion 61A and the front-side conveyance portion 61B convey the waste toner in different directions.

It is noted that although the present embodiment describes the configuration where the conveyance screw 61 includes the rear-side conveyance portion 61A and the front-side conveyance portion 61B, the whole conveyance screw 61 may be composed of only the front-side conveyance portion 61B.

Meanwhile, when the waste toner is conveyed in the toner path portion 67 to the case main body 52, the waste toner may stagnate in the toner path portion 67, and the toner path portion 67 may be clogged with the waste toner. In the present embodiment, to eliminate the stagnation or clogging with the waste toner, the case main body 52 is provided with the loosening mechanism 90 including a loosening member 92 that is described below.

The loosening mechanism 90 includes an eccentric shaft 91 (an example of a conversion portion of the present disclosure) and the loosening member 92 (an example of a moving member of the present disclosure).

As shown in FIG. 5 and FIG. 6, the eccentric shaft 91 is provided in a rotation shaft 63 of the conveyance screw 61 to convert a rotary motion of the rotation shaft 63 into a reciprocating motion in conjunction with the rotation of the rotation shaft 63. The eccentric shaft 91 is stretched over between a pair of disk members 64 to extend in parallel to the rotation shaft 63, wherein the pair of disk members 64 are formed integrally with the rotation shaft 63 and provided at a front end of the rotation shaft 63. The eccentric shaft 91 is a columnar shaft member, wherein the axial center of the eccentric shaft 91 is displaced from the axial center of the rotation shaft 63 in a direction perpendicular to the rotation shaft 63. The displacement width of the eccentric shaft 91 with respect to the rotation shaft 63 is an element for determining the movement width of the reciprocating motion of the loosening member 92. In the present embodiment, the displacement width is set to a length that is required to loosen the stagnation or clog of the waste toner in the toner path portion 67.

When a rotational driving force is input to the rotation shaft 63 and the conveyance screw 61 rotates, the eccentric shaft 91 rotationally moves around the rotation shaft 63 in conjunction with the rotation of the conveyance screw 61. The eccentric shaft 91 is coupled with an end of the loosening member 92. As described above, when the eccentric shaft 91 rotationally moves around the rotation shaft 63, the loosening member 92 performs the reciprocating motion.

It is noted that the eccentric shaft 91 is not limited to the above-described columnar member, but may be anything that includes a shaft whose axial center is displaced from that of the rotation shaft 63, and may be anything that has at least a structure for converting the rotary motion of the rotation shaft 63 into the reciprocating motion.

FIG. 6 is a cross-section diagram of the toner path portion 67 provided in the case main body 52. As shown in FIG. 6, one end of the loosening member 92 is coupled with the eccentric shaft 91, and the other end is disposed inside the toner path portion 67 as a free end. With this configuration, upon receiving a force from the eccentric shaft 91, the loosening member 92 reciprocatingly moves in an inclined direction D12 along the inclined surface 67B of the toner path portion 67.

As shown in FIG. 6, the loosening member 92 includes a coupling portion 94, a lower extending portion 95 (an example of a first extending portion of the present disclosure), and an upper extending portion 96 (an example of a second extending portion of the present disclosure), wherein the coupling portion 94 is externally fitted to the eccentric shaft 91. The lower extending portion 95 and the upper extending portion 96 extend inside the toner path portion 67 from the coupling portion 94 toward the reception port 65E, and reciprocatingly move in the inclined direction D12 along the inclined surface 67B as the eccentric shaft 91 rotationally moves.

The loosening member 92 is formed from, for example, a metal linear member having low flexibility, and the coupling portion 94, the lower extending portion 95, and the upper extending portion 96 are integrally formed by bending a metal steel wire. Of course, the loosening member 92 is not limited to the one formed from a metal linear member, but may be formed from, for example, a hard resin.

As shown in FIG. 6, the lower extending portion 95 is disposed on the inclined surface 67B side. In addition, the upper extending portion 96 is disposed above the lower extending portion 95. In other words, the upper extending portion 96 is disposed at a position that is separated from the lower extending portion 95 by a predetermined interval in a separating direction D11 (an example of a first direction of the present disclosure), wherein the separating direction D11 is a direction separating from the inclined surface 67B. In the present embodiment, the upper extending portion 96 is disposed above the lower extending portion 95 such that the upper extending portion 96 makes a predetermined angle with respect to the lower extending portion 95 in the separating direction D11. It is noted that the predetermined angle is determined such that the upper extending portion 96 can reciprocatingly move inside the toner path portion 67 between the inclined surface 67B and the cover portion 52B. In the present embodiment, the predetermined angle is set to be equal to or slightly smaller than an angle between the inclined surface 67B and the cover portion 52B.

Figure 7:
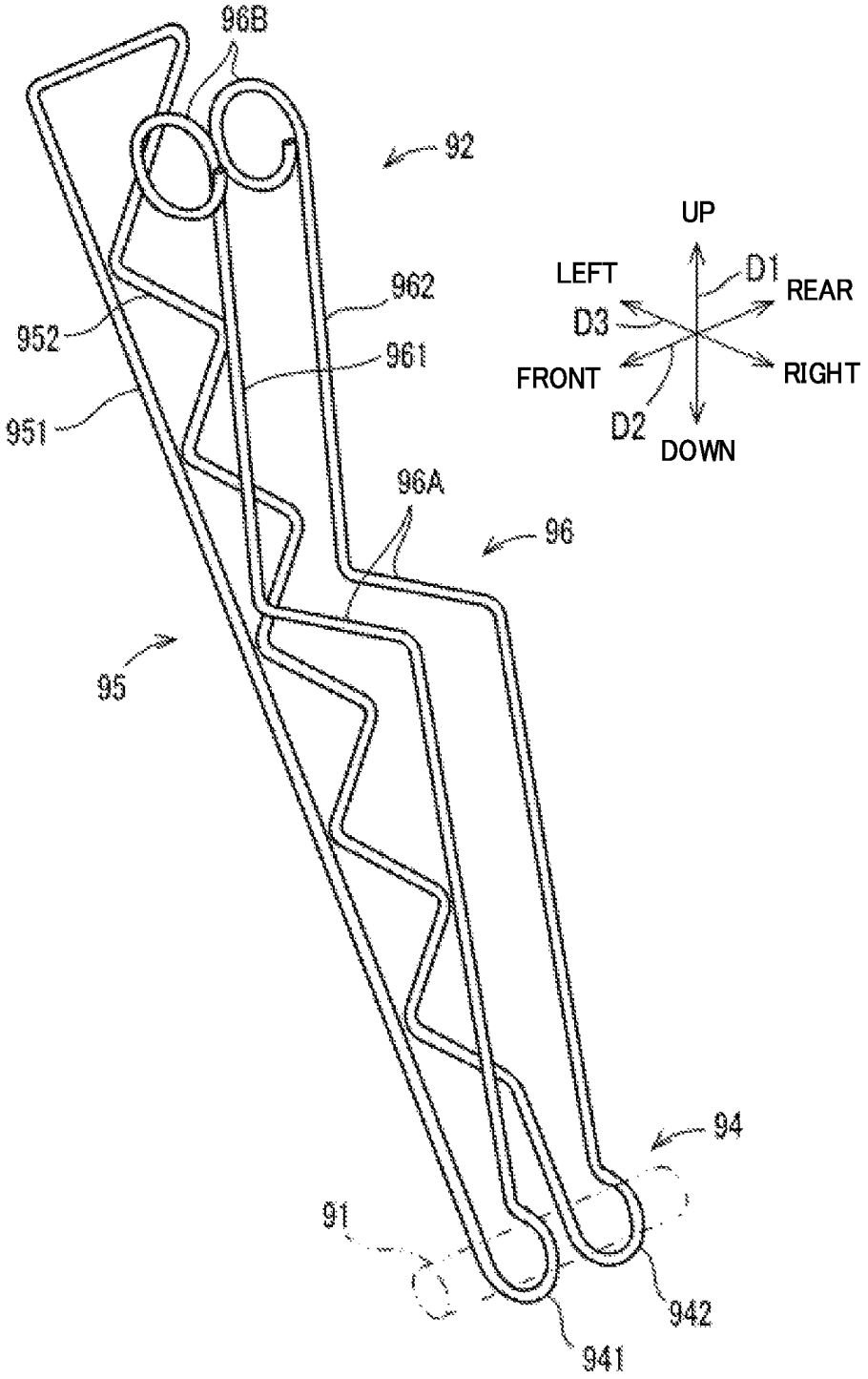
FIG. 7 is a perspective diagram showing the loosening member provided in the waste toner storage case.

FIG. 7 is a perspective diagram showing the loosening member 92. As shown in FIG. 7, the coupling portion 94 of the loosening member 92 includes a pair of coupling rings 941 and 942 that are separated from each other in the axial direction of the eccentric shaft 91. The coupling rings 941 and 942 are each formed by bending the linear member in an arc shape that is an approximate shape of a ring, and the outer diameter of the coupling rings 941 and 942 is slightly larger than the outer diameter of the eccentric shaft 91. The coupling rings 941 and 942 are coupled with the eccentric shaft 91.

The lower extending portion 95 includes a straight portion 951 and a serrated portion 952 that extend from the coupling portion 94 along the inclined surface 67B. The straight portion 951 extends straight from the coupling ring 941 toward the reception port 65E. The serrated portion 952 extends from the coupling ring 942 toward the reception port 65E. In addition, the serrated portion 952 is formed by bending the linear member in a serrated shape in the width direction of the toner path portion 67 (in the front-rear direction D2).

When the conveyance screw 61 is rotated, the eccentric shaft 91 rotationally moves and the rotary motion of the rotation shaft 63 is converted into the reciprocating motion by the eccentric shaft 91. At this time, the reciprocating motion is transmitted from the coupling portion 94 to the lower extending portion 95 of the loosening member 92, and the lower extending portion 95 reciprocatingly moves in the inclined direction D12 along the inclined surface 67B. As a result, in a case where the waste toner adheres to the inclined surface 67B of the toner path portion 67, the waste toner is scraped off by the lower extending portion 95 that reciprocatingly moves, and the waste toner moves downward along the inclined surface 67B while being stirred. In particular, since the lower extending portion 95 is provided with the serrated portion 952 having the serrated shape, it is possible to scrape off the waste toner from the inclined surface 67B effectively.

In the present embodiment, a restriction member 93 is provided, wherein the restriction member 93 presses the loosening member 92 against the inclined surface 67B so that a tip portion (an extension end) of the lower extending portion 95 is pressed and contacted to the inclined surface 67B. The restriction member 93 is configured to restrict the lower extending portion 95 from being displaced in the separating direction D11 so that the lower extending portion 95 of the loosening member 92 is not separated from the inclined surface 67B. In the present embodiment, as shown in FIG. 6, an arch-shaped restriction member 93 is provided on the inclined surface 67B, and the straight portion 951 is inserted between the restriction member 93 and the inclined surface 67B. This prevents the lower extending portion 95 from floating from the inclined surface 67B when the eccentric shaft 91 rotationally moves. In addition, since this causes the tip portion of the lower extending portion 95 to be always in contact with the inclined surface 67B, the effect of removing the adhered waste toner from the inclined surface 67B is improved.

In addition, as shown in FIG. 7, the upper extending portion 96 includes a pair of stirring portions 961 and 962 that extend from the coupling portion 94 along the inclined surface 67B. The stirring portions 961 and 962 stir and loosen the waste toner that has clogged the space between the inclined surface 67B and the cover portion 52B. The stirring portion 961 is disposed at a position corresponding to the straight portion 951 of the lower extending portion 95 to extend from the coupling ring 941 toward the reception port 65E. In addition, the stirring portion 962 is disposed at a position corresponding to the serrated portion 952 of the lower extending portion 95 to extend from the coupling ring 942 toward the reception port 65E.

The stirring portions 961 and 962 are formed in the same shape. Each of the stirring portions 961 and 962 includes a crank portion 96A (an example of a first bent portion of the present disclosure) and a ring portion 96B (an example of a second bent portion of the present disclosure), wherein the crank portion 96A is formed approximately at an intermediate position of each of the stirring portions 961 and 962, and the ring portion 96B is formed at the tip of each of the stirring portions 961 and 962. The crank portion 96A is formed to extend straight from the coupling portion 94 to the intermediate position to make the predetermined angle with respect to the lower extending portion 95, be bent at the intermediate position toward the lower extending portion 95, and be further bent in the separating direction D11. Each of the stirring portions 961 and 962 extends straight from the crank portion 96A to the tip to make the predetermined angle, and the ring portion 96B is formed at the tip. In addition, the ring portion 96B is bent in an opposite direction to the separating direction D11, namely, toward the inclined surface 67B with respect to the straight portion extending from the crank portion 96A to the tip.

Meanwhile, in a conventional configuration where a moving member reciprocatingly moves in a simple manner along the inclined surface 67B of the toner path portion 67, if the waste toner flows in and stagnates on the moving member, it may happen that only the waste toner near the inclined surface 67B is broken, the waste toner above the loosening member 92 remains unbroken, and the toner path portion 67 is clogged with the waste toner.

Figure 8:
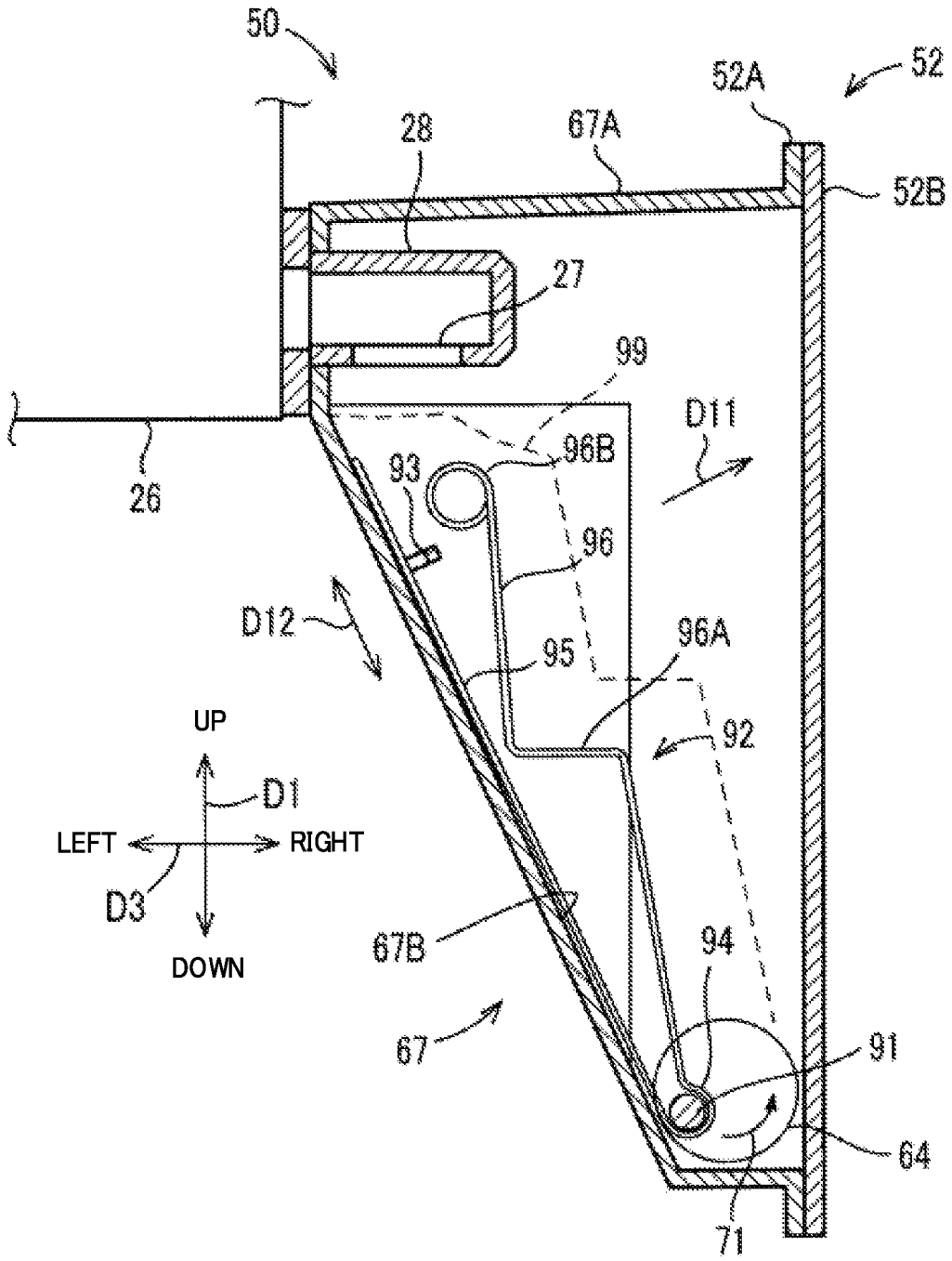
FIG. 8 is a diagram for explaining an operation of the loosening member.
Figure 9:
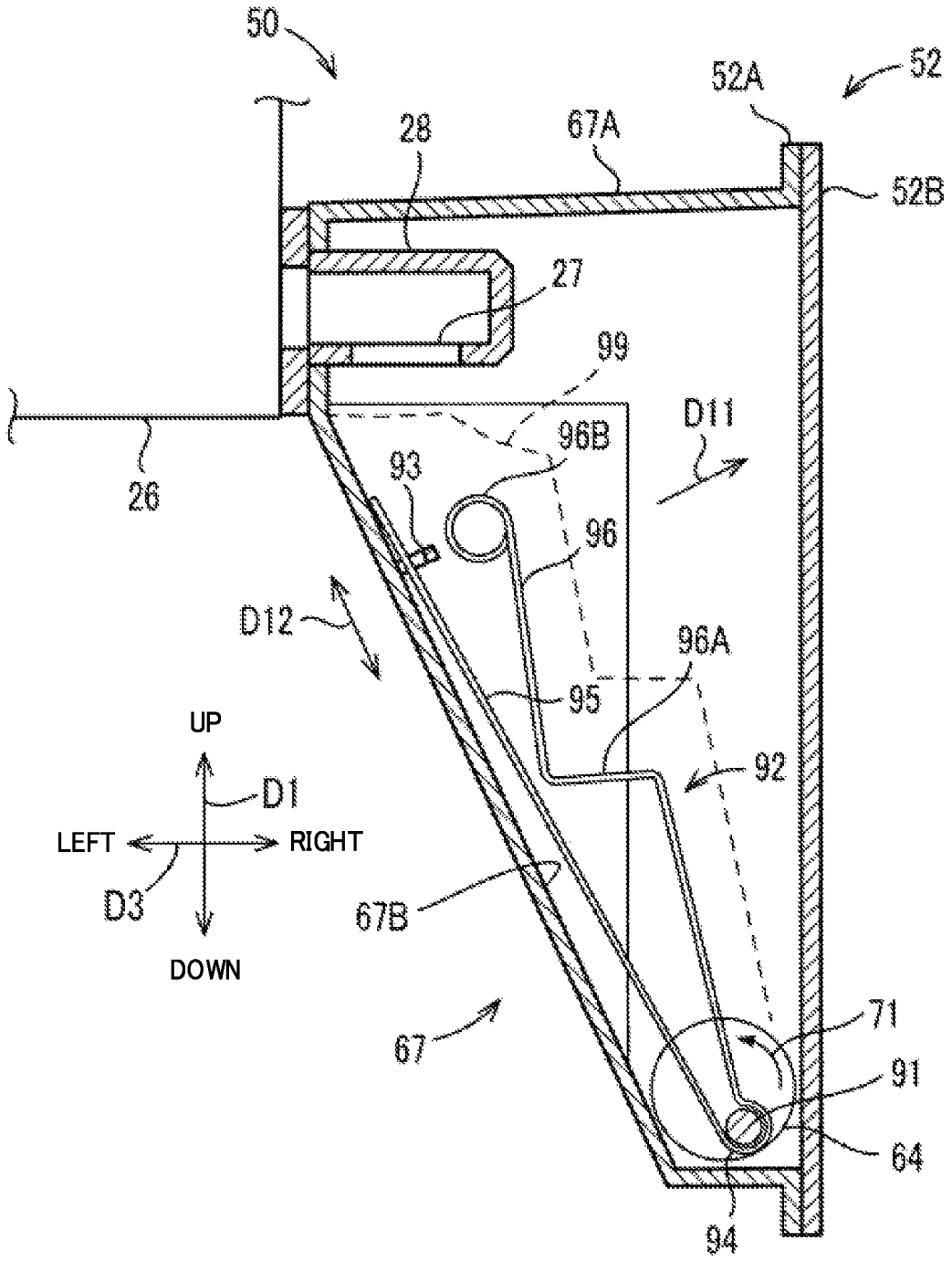
FIG. 9 is a diagram for explaining an operation of the loosening member.
Figure 10:
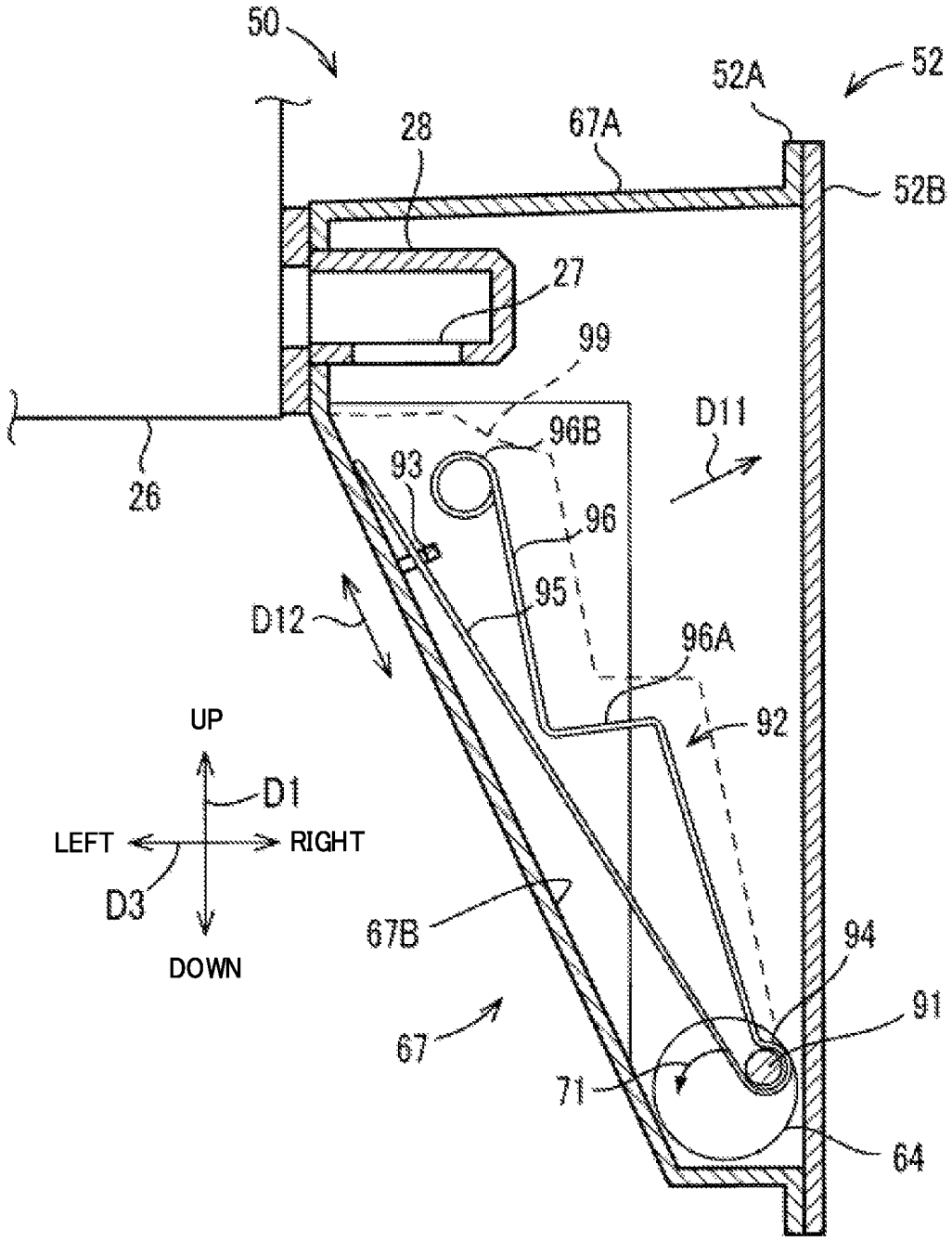
FIG. 10 is a diagram for explaining an operation of the loosening member.

In the present embodiment, since the loosening member 92 is provided in the waste toner storage case 50 as described above, it is possible to prevent the waste toner from stagnating in and clogging the toner path portion 67 that extends from the reception port 65E that receives the waste toner, to the storage space in the case main body 52. That is, when, in the state shown in FIG. 6, the conveyance screw 61 is rotated in the direction indicated by the arrow 71 and the eccentric shaft 91 rotationally moves in that direction, as the eccentric shaft 91 is displaced in the inclined direction D12 and in the separating direction D11, the loosening member 92 reciprocatingly moves in the inclined direction D12 while performing an oscillation motion in the separating direction D11, as shown in FIG. 8 to FIG. 10. During this process, for one rotation of the conveyance screw 61, the loosening member 92 operates in a range indicated by a dotted-line surrounding portion 99 shown in FIG. 8 to FIG. 10. With this configuration, even in a case where as much waste toner as impossible to be scraped loose by the lower extending portion 95 flows onto the inclined surface 67B and the toner path portion 67 is clogged with the waste toner, the waste toner near the inclined surface 67B is loosened by the lower extending portion 95, and the waste toner clogging the space between the inclined surface 67B and the cover portion 52B is stirred and loosened by the upper extending portion 96. As a result, it is possible to prevent the toner path portion 67 from being clogged with the waste toner, and even if the toner path portion 67 is clogged with the waste toner, it is possible to move down the clogging waste toner into the case main body 52.

In addition, the crank portion 96A and the ring portion 96B provided in the loosening member 92 make it possible to loosen the waste toner clogging the space between the inclined surface 67B and the cover portion 52B more effectively.

The above-described embodiment shows, as one example, a configuration where the crank portion 96A and the ring portion 96B are provided in the upper extending portion 96. However, in the present disclosure, either the crank portion 96A or the ring portion 96B may be provided in the upper extending portion 96. Alternatively, neither the crank portion 96A nor the ring portion 96B may be provided in the upper extending portion 96, but the upper extending portion 96 may be formed to extend straight to make the predetermined angle with respect to the lower extending portion 95.

Figure 11:
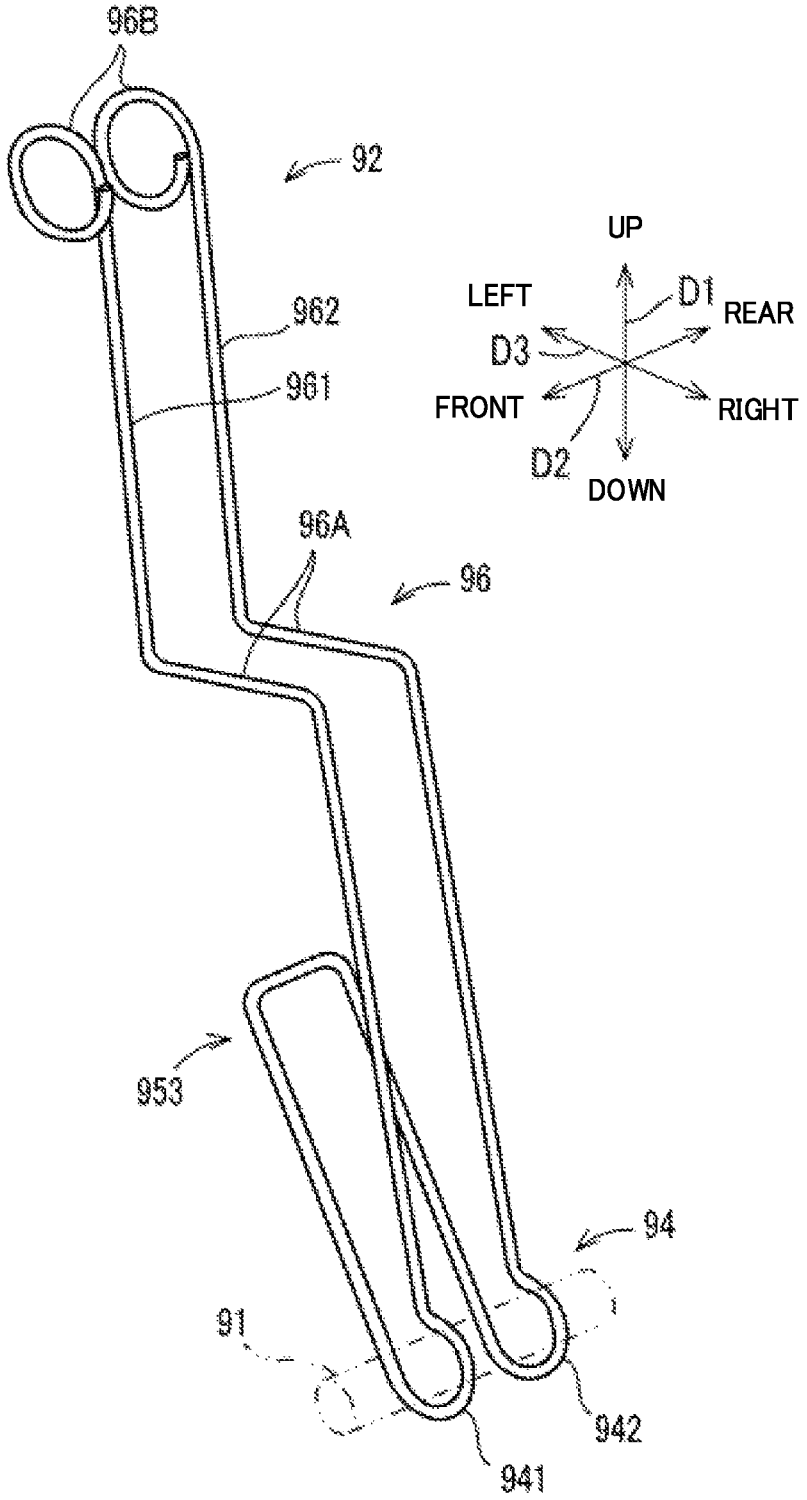
FIG. 11 is a perspective diagram showing a modification of the loosening member according to the embodiment of the present disclosure.

In addition, the above-described embodiment shows, as one example, the loosening member 92 that includes the lower extending portion 95 shown in FIG. 7. However, the loosening member 92 is not limited to this configuration. For example, the loosening member 92 may include, instead of the lower extending portion 95, a lower extending portion 953 (an example of the first extending portion of the present disclosure) that extends along the inclined surface 67B as shown in FIG. 11. Here, the lower extending portion 953 has the same configuration as the lower extending portion 95 except for the length and the shape, and is configured to cause the upper extending portion 96 to be separated from the inclined surface 67B in the separating direction D11 by coming in contact with the inclined surface 67B. With this configuration, too, the waste toner clogging the space between the inclined surface 67B and the cover portion 52B is loosened by the upper extending portion 96.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A waste toner storage case comprising:

a case main body configured to store waste toner discharged from an image carrier included in an image forming apparatus;

a waste toner path provided in the case main body and including an inclined guide surface that guides the waste toner diagonally downward from a reception port that receives the waste toner from the image carrier, toward an inside of the case main body;

a conveyance portion provided in the inside of the case main body in such a way as to be rotatable and configured to, by being rotated, convey the waste toner in the case main body in a rotation axis line direction;

a conversion portion provided in a rotation shaft of the conveyance portion and configured to convert a rotary motion into a reciprocating motion in conjunction with a rotation of the rotation shaft; and a moving member coupled with the conversion portion and extending in the waste toner path from a coupling portion that couples the moving member with the conversion portion, toward the reception port, the moving member configured to reciprocatingly move in a direction along the inclined guide surface in accordance with the reciprocating motion transmitted from the conversion portion, wherein the moving member includes:

a first extending portion extending from the coupling portion to the reception port; and a second extending portion extending from the coupling portion to the reception port to make a predetermined angle with respect to the first extending portion in a first direction that is a direction separating from the inclined guide surface.

2. The waste toner storage case according to claim 1, wherein the second extending portion includes a first bent portion that is bent in the first direction at a position between the coupling portion and an extension end of the second extending portion.

3. The waste toner storage case according to claim 1, wherein the second extending portion includes a second bent portion that is bent toward the inclined guide surface at an extension end of the second extending portion.

4. The waste toner storage case according to claim 1, further comprising:

a restriction member configured to restrict the moving member toward the inclined guide surface so that the first extending portion abuts on the inclined guide surface.

5. The waste toner storage case according to claim 1, wherein the image carrier is a transfer belt configured to carry a plurality of toner images of a plurality of colors transferred to the image carrier during an image formation process performed in the image forming apparatus, and the waste toner path is provided in the case main body at one side in the rotation axis line direction, receives the waste toner from the transfer belt, and guides the waste toner toward the inside of the case main body.

6. An image forming apparatus comprising:

the waste toner storage case according to claim 1;

the image carrier configured to carry a toner image; and a waste toner removing portion configured to remove the waste toner from a surface of the image carrier and discharge the waste toner to the waste toner storage case.

* * * * *